United States Patent [19]

Johnson

[11] 4,291,519

[45] Sep. 29, 1981

[54] BOTTLE CARTON FILLING MACHINE

[76] Inventor: Daniel Johnson, 9877 Myron St., Pico Rivera, Calif. 90660

[21] Appl. No.: 154,941

[22] Filed: May 30, 1980

[51] Int. Cl.[3] ..... B65B 35/36; B65B 5/06; B65B 5/08; B65B 5/10

[52] U.S. Cl. ..... 53/534; 53/244; 53/245; 53/250

[58] Field of Search ..... 53/48, 244, 245, 247, 53/250, 252, 467, 475, 534

[56] References Cited

U.S. PATENT DOCUMENTS

| | | | |
|---|---|---|---|
| 2,318,598 | 5/1943 | Davis | 53/534 |
| 2,699,278 | 1/1955 | Wysocki | 53/534 |
| 2,840,965 | 7/1958 | Lewis | 53/534 |
| 2,971,309 | 2/1961 | Miskel et al. | 53/534 X |
| 3,284,985 | 11/1966 | Roth | 53/247 |
| 3,332,200 | 7/1967 | Englander | 53/534 X |
| 3,363,394 | 1/1968 | Rainbow | 53/534 X |
| 3,443,355 | 5/1969 | Birrell | 53/534 |
| 3,479,795 | 11/1969 | Martin | 53/244 X |
| 3,486,296 | 6/1967 | Hechenleitner | 53/534 |
| 3,780,492 | 12/1973 | Corderoy | 53/247 |

*Primary Examiner*—Horace M. Culver
*Attorney, Agent, or Firm*—Victor Sepulveda

[57] ABSTRACT

Herein described is an automated machine for filling a carton or crate with containers such as liquid filled plastic bottles. The machine includes a filling station, a stand having a conveyor line sequentially feeding empty cartons to the filling station and a conveyor line sequentially removing filled cartons from the filling station. The conveyor line to the filling station is substantially higher in elevation than the conveyor line from the filling station. A ramp interconnects the two conveyor lines and is positioned directly under the filling station. Empty cartons from the higher conveyor line are allowed to slide down the ramp on suitable tracks onto the lower conveyor line. Appropriate stop mechanism timed with mechanism in the filling station cause the carton being filled to stop at selected positions in order to be filled with bottles. A feed conveyor line sequentially supplies bottles to the filling station and onto a platform positioned directly over the ramp and empty cartons disposed therein. A feed rack comprising a U-shaped member is disposed directly over the platform and as a predetermined number of bottles are disposed within the U-shaped feed rack it is moved angularly, sliding the bottles from the platform into the waiting carton. Means timed with the position of the carton then sequentially moves the carton to a second (or third) position and the feed rack is moved to receive a second plurality of bottles. The sequence is then repeated for each carton position.

5 Claims, 10 Drawing Figures

BOTTLE CARTON FILLING MACHINE

BACKGROUND OF THE INVENTION

This invention relates to automatic carton or crate filling machines and more particularly to a novel and improved machine for filling empty packing cartons or crates which places a predetermined number of containers such as liquid filled plastic bottles into a carton or crate.

As used herein and in the claims, the term case or carton includes any type of packing containers constructed, for example, of cardboard, wood, plastic or other suitable material. Further, while the specification of the shown embodiment is particularly drawn to plastic milk or water bottles, the objects which are placed into the cartons by this invention may be of a variety of different objects, but at this point in time, it is believed that the best mode intended is bottles.

Heretofore many different types of machines have been used to place objects into packing cartons, all of which include very complicated mechanisms and machinery which include machines which actually pick up the bottles and place them into the carton. All of these prior art systems are quite complicated and thus expensive.

Due to the recent advent of the use of plastic bottles, and especially those bottles manufactured of relatively thin plastic materials and basically the one-gallon bottle, a need has arisen for a machine which delicately handles these bottles. This is especially true when the bottle to be packed into a case is already filled.

A feature of the present invention includes providing a simple, inexpensive case filling machine which automatically and efficiently accomplishes the needs now present in the industry.

SUMMARY OF THE INVENTION

Briefly described, the present invention comprises a machine which places containers into a case. Particularly the containers may be liquid filled plastic bottles.

A stand is included which has a filling station wherein the bottles are filled into the case. A first conveyor line is disposed to supply empty cases to the apparatus, a second conveyor line is disposed to take bottle filled cases from the apparatus. The first conveyor line is disposed on an elevation higher than the second conveyor line. A ramp is disposed between each conveyor line so that the empty cases are allowed to slide from one conveyor line to another under the filling station while being filled with bottles. A platform is disposed at the filling station directly over the case to be filled as the case is positioned thereunder. A feed rack includes a U-shaped member which is adapted for angular movement is positioned directly over the platform. A bottle feed conveyor is positioned to sequentially feed bottles into the open end of the U-shaped feed rack. After a predetermined number of bottles are positioned into the feed rack, angular movement of the feed rack causes the bottles to slide from the rack into an awaiting case. The case is sequentially moved by stop mechanisms so that an appropriate number of rows of bottles are fed into the case at timed intervals.

DESCRIPTION OF THE DRAWINGS

These and other features and advantages will become more apparent to those skilled in the art when taken into consideration with the following detailed description wherein like referenced numerals indicate like and corresponding parts throughout the several views and wherein.

DESCRIPTION OF THE SHOWN EMBODIMENT

Figure 1:
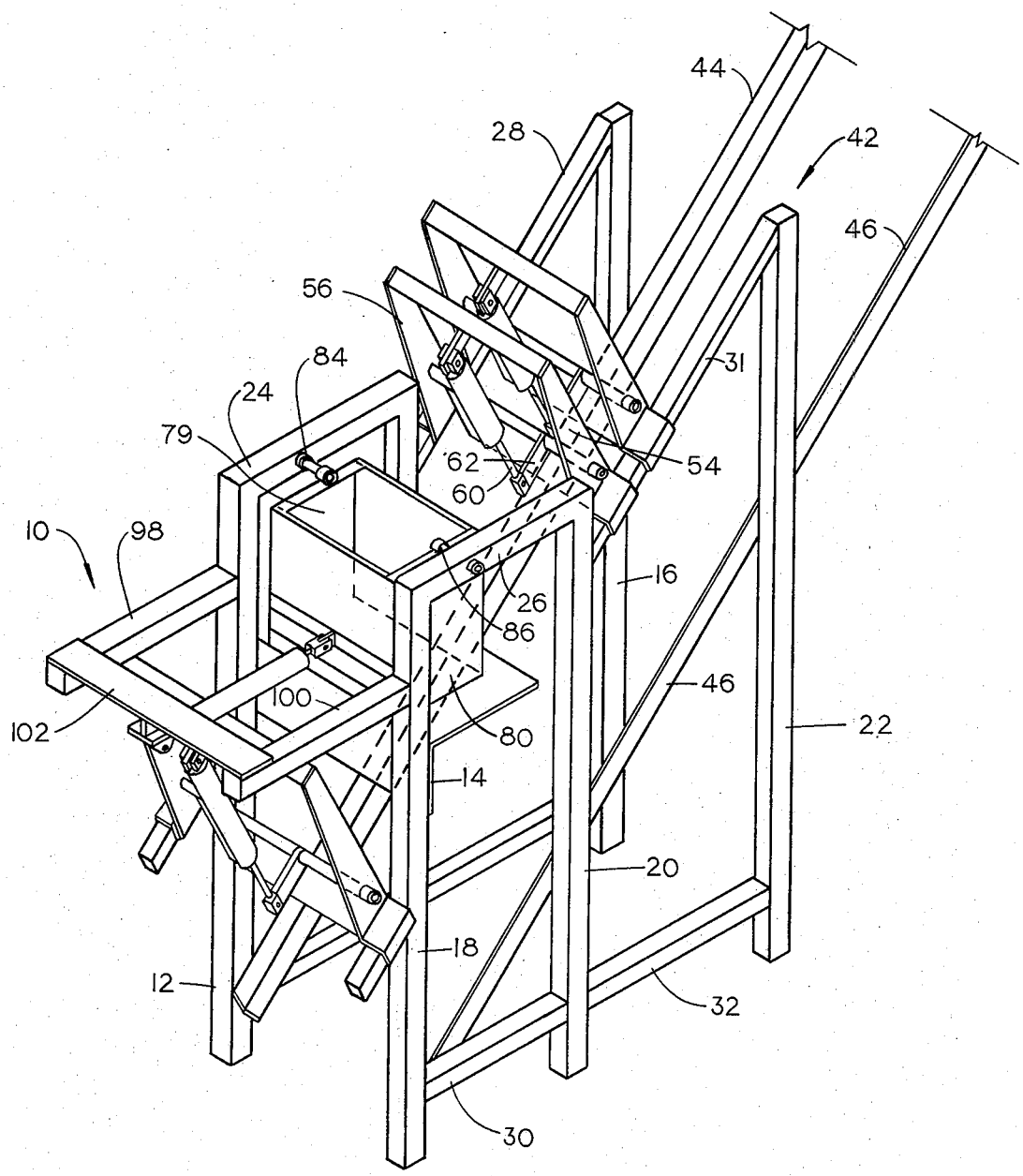
FIG. 1 is a perspective view of the case filling apparatus of the present invention.

Turning now to a more detailed description of the shown embodiment, FIG. 1 illustrates in perspective view, the carton filling apparatus 10 of the present invention which is constructed to stand upright on a plurality of vertically disposed legs 12, 14, 16, 18, 20 and 22, and in the embodiment shown there are six legs which may be preferably comprised of angle iron or other material suitable to lend stability and support to the apparatus. Legs 12 and 14 are connected together at the top end thereof by a crossbar 24 and legs 18 and 20 are suitably coupled together by a crossbar 26. A suitable means for coupling the crossbars together would be by welding or the like. Further, the crossbars may also be comprised of angle iron. Legs 16 and 22 extend above the apparatus 10 and somewhat higher than the legs 12, 14, 18 and 20. The uppermost end of leg 16 is connected to the leg 14 by an angularly disposed crossbar 28 which may be welded into the leg 14. Likewise, a crossbar 31 is angularly disposed downwardly from the top of leg 22 and suitably mounted into leg 20. Again, these crossbars may also be constructed of angle iron.

A bottom brace 30 braces legs 18 and 20 and is suitably fitted near the lower edge of the legs 18 and 20. A further brace 32 is suitably connected between legs 20 and 22 and lends stability and strength to the overall construction. Similar braces are provided between legs 12 and 14 and 14 and 16.

Figure 2:
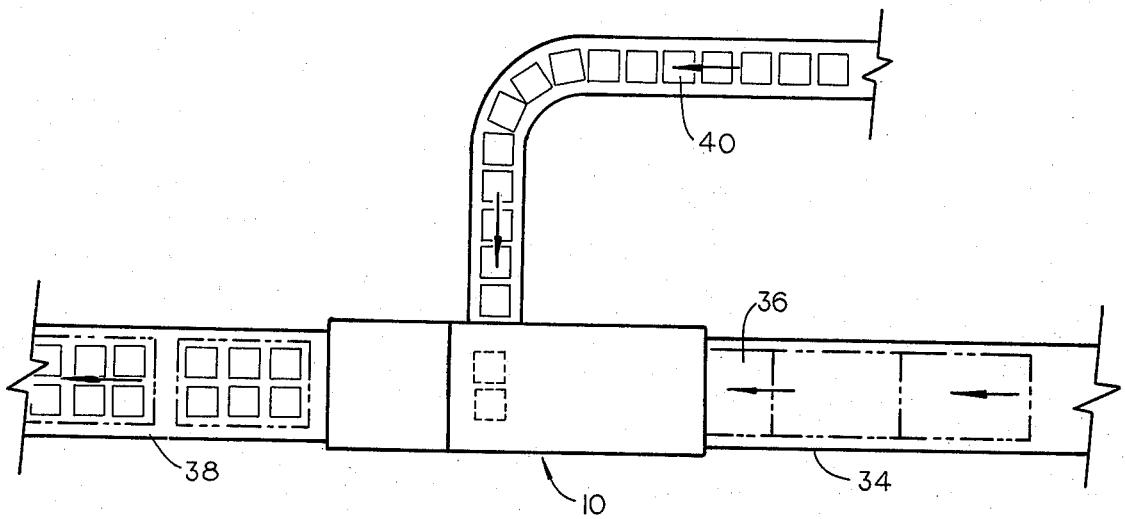
FIG. 2 is a schematic view of the case filling apparatus showing the inlet feed ramps or conveyors feeding the case and containers into the carton filling device.

Referring now to FIG. 2, there is shown a schematic drawing illustrating in block diagram form the carton filling apparatus 10. A first conveyor 34 conveys sequentially in a single-file order a plurality of cartons 36. These cartons may be made of cardboard, wood, plastic or any other suitable material, but will be referred to herein as cartons. The cartons 36 are fed one at a time into the carton filling apparatus 10 and exits the other side through a suitable conveyor 38 filled with the containers. A suitable conveyor 40 feeds sequentially the containers or bottles which are to be filled, into the cartons 36 as they progress from ramp 34. In the shown embodiment, the containers are milk bottles or water bottles which are filld with liquid and comprise of a plastic material. The conveyor 34 enters the carton filling apparatus at a higher elevation than the conveyor 38 exits therefrom. An angularly disposed ramp 42 couples the conveyor or ramp 34 with the conveyor or ramp 38 and includes a pair of laterally disposed rails 44 and 46. When the cartons 36 to be filled with the containers reach the ramp 42, these will automatically slide from the upper ramp 34 to the lower ramp 38.

To cause the cartons to stop at predetermined positions, means are provided at certain incremental positions. In the shown embodiment, a carton will stop in three positions. At each position two bottles are automatically fed into the carton until a total of six bottles fill each carton. The apparatus of the present invention can be constructed and arranged to provide any number of bottles in a row on any number of rows and further accomodate different carton sizes and bottle sizes.

Figure 6:
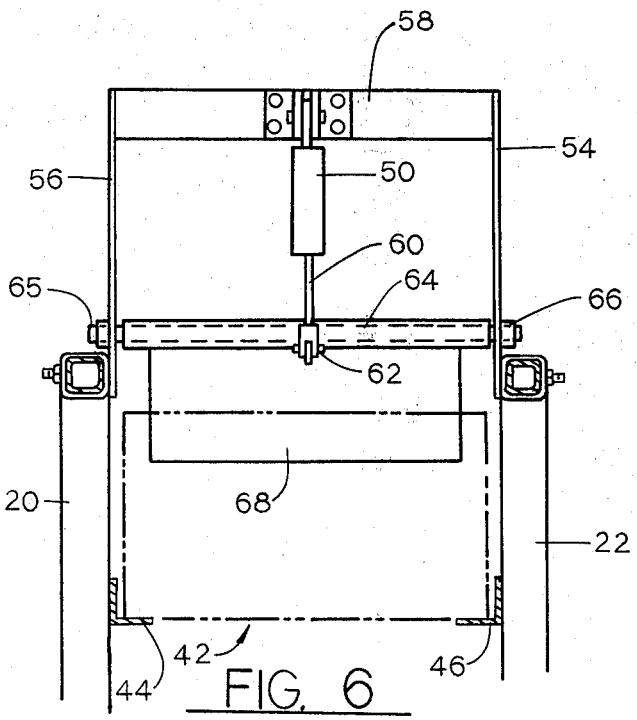
FIG. 6 is a rear view of the case filling apparatus illustrating the incrementing apparatus used for incrementing the case in various positions.
Figure 7:
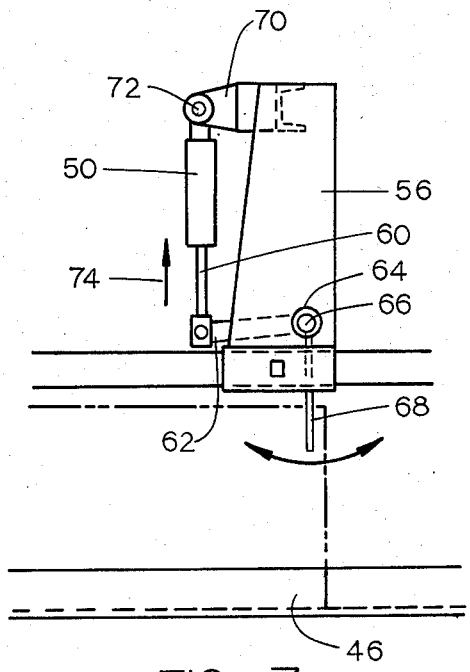
FIG. 7 is a side view of the apparatus shown in FIG. 6.

To actuate incrementing apparatus, a piston 50 is used to position a stop mechanism which protrudes downwardly into the direction of travel of the carton as it slides down the ramp 42. These pistons 50 are best shown in FIGS. 6 and 7. To hold the pistons 50 in place a pair of upstanding side members 54 and 56 are suitably welded to the crossbar 28 and 31 and includes a support bracket 58 extending therebetween. Piston 50, which can be operated either by hydraulics or electrically, has a connecting rod 60 therein connected to an arm 62 to a tubular crossmember 64. The tubular crossmember 64 is pivoted for rotation by the axle 66 and are suitably coupled together by bolts or the like. An extending stop flange 68 extends downwardly from the crossbar 64 and is caused to rotate by the piston 50 on its downward stroke. The top of piston 50 is connected to a bracket 70 which extends outwardly from the top of the support bracket 58 and coupled thereto by suitable means. The bracket is also connected to the piston by a pivot pin 72. Actuation of the piston causes the connecting rod 60 to be drawn upwardly as shown by the arrow 74 causing the stop flange 68 to swing upwardly and when the piston 50 is de-energized the connection rod 60 goes downwardly and causes the stop flange 68 to be extended downwardly.

While the above discussion only deals with the stop piston 50, the same mechanical construction and operation applies to stop piston 48 and 52 and for sake of clarity their construction and operation will not be discussed herein.

Now as a container 36 advances towards a selected piston, it is sequentially energized so that the stop flange 68 on the first piston 48 extends downwardly. After the first bottles are fed into the carton, as will hereinafter be discussed, this piston 48 de-energizes and its stop flange 68 swings upwardly causing the box to advance downwardly and be caught by the stop flange 68 on piston 50. Thereafter the bottles are fed into the box 36 and thereafter the box is advanced downwardly to where the front edge 36*a* of the carton 36 thereof comes in contact with the stop flange 68 of piston 52 and the remainder of the bottles are fed into the carton 36.

In order to facilitate the advancement of the bottles from the conveyor 40 into the container 36, the bottles are automatically moved down the conveyor and into a feed rack 80. The feed rack 80 comprises a U-shaped box-like member which has an opening 79 on one end thereof and on the same end as the ramp 40 feeds the bottles thereto. The feed rack 80 includes two sides 81 and 83 and an end 85 and the bottles fit between the sides 81 and 83 and against the end 85. The specific embodiment provides that two bottles will be automatically fed into the feed rack 80 and appropriate microswitches therein will be energized when the rack 80 includes two bottles. A platform 82 is provided which extends outwardly from leg 18 and is suitably braced thereon and coupled thereto so that the bottles can slide from the conveyor 40 onto the platform 82 and be confined in space between sides 81 and 83 in the feed rack 80.

Figure 3:
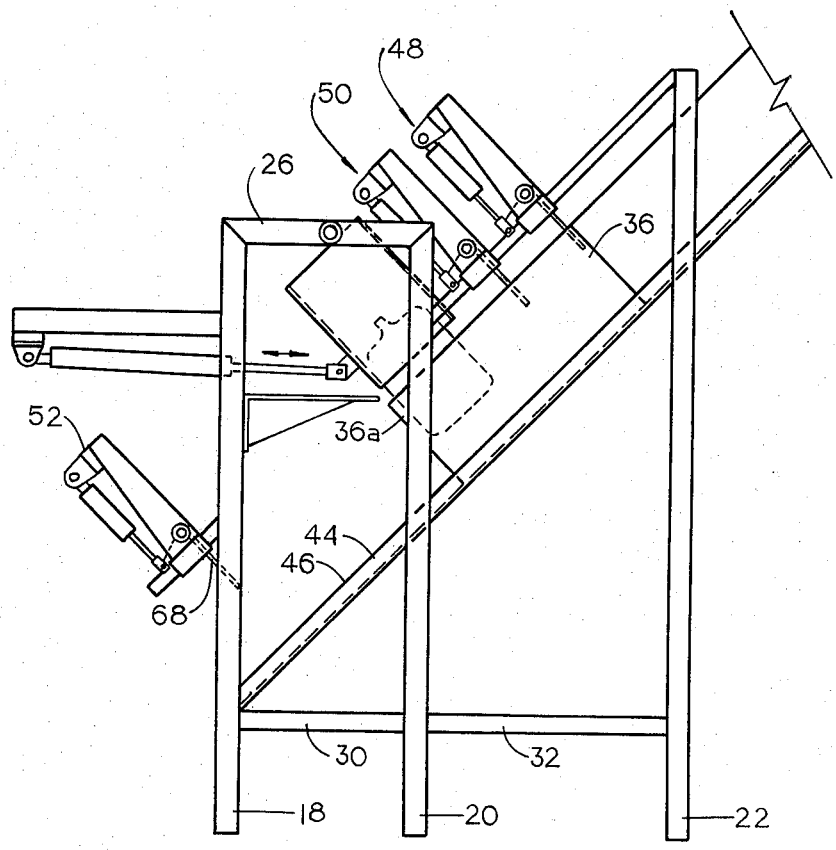
FIG. 3 is a side view of the case filling apparatus illustrating the case in a first incremented position.
Figure 4:
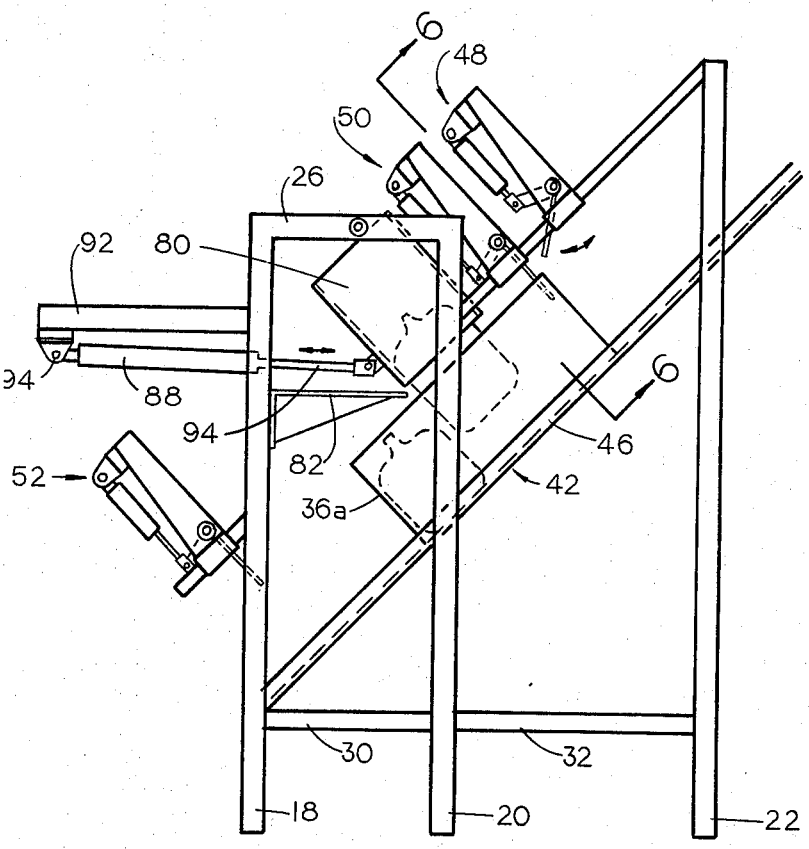
FIG. 4 is a side view of the case filling apparatus similar to FIG. 3 which illustrates the case in a second incremental position.
Figure 5:
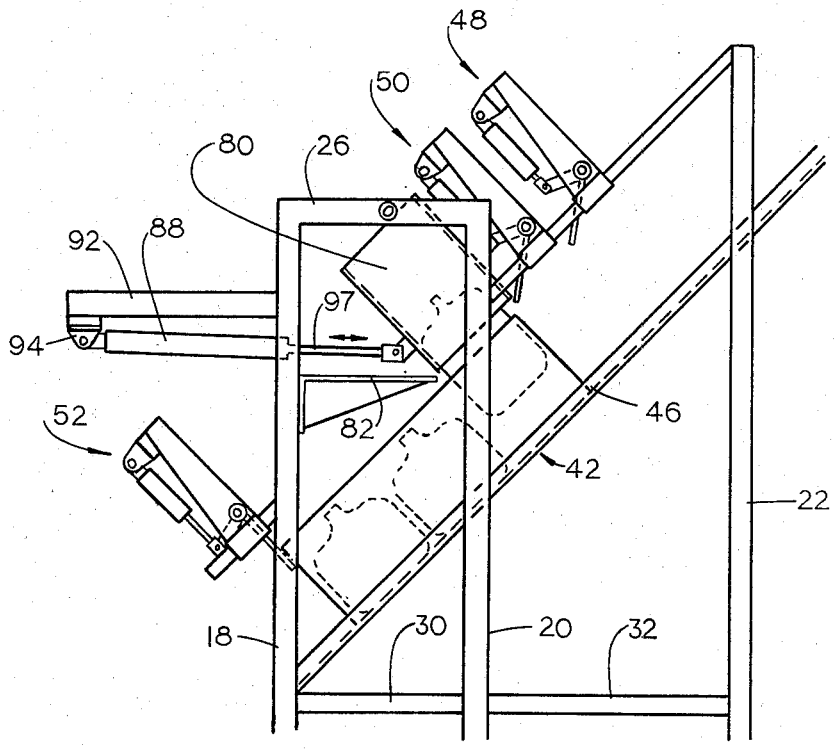
FIG. 5 is a side view of the case filling apparatus of FIGS. 3 and 4 showing the case filling apparatus in its final incremental position.
Figure 9:
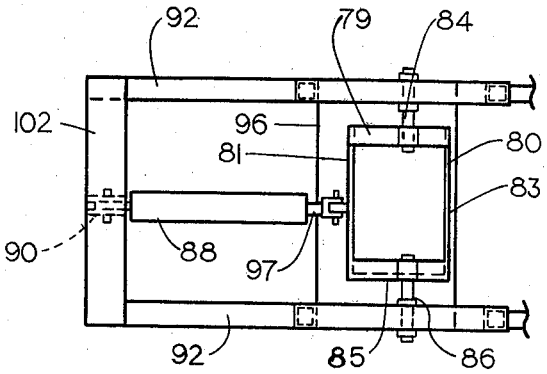
FIG. 9 is a top view of the feed rack for receiving containers.
Figure 8:
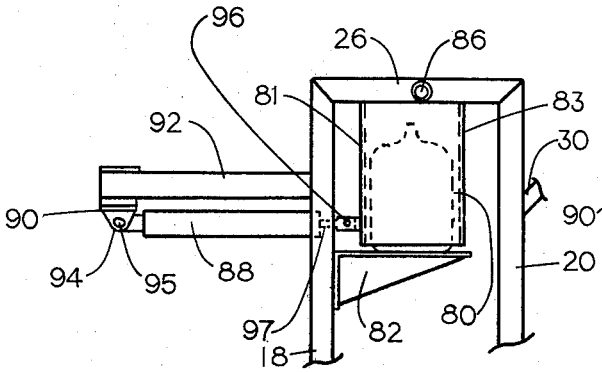
FIG. 8 illustrates a segmented view of the feed rack in its position for receiving containers therein.
Figure 10:
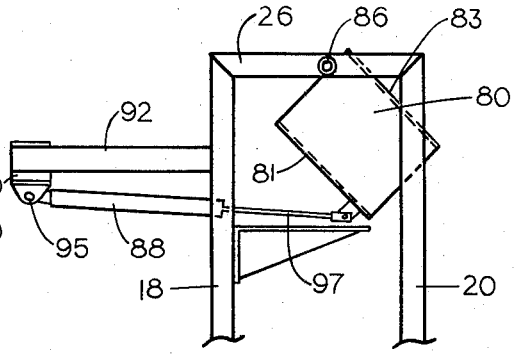
FIG. 10 is a drawing showing the feed rack of FIG. 8 with the feed rack in an angled position for positioning the containers into the carton.

The feed rack 80 is coupled by a pair of axles 84 and 86 to the appropriate corresponding crossbar 24 and 26 so that it can angularly swing inwardly and outwardly as best shown in FIGS. 8, 9 and 10. To facilitate the movement of the feed rack 80 to an angular position whereby the bottles therein will be slid from the platform 82 into the appropriate container 36 at specific stop increments, a piston 88 is coupled by a brace 90 to an extending bracket 92 and pivoted thereon at a point 94 by a suitable pivot pin 95. A connecting rod 97 is coupled to a bracket 96 and pivoted thereon in a suitable manner and the other end of bracket 96 is coupled directly onto the feed rack 80. When the piston is energized the connecting rod pushes the feed rack outwardly whereby it pivots at its pivot axles 84 and 86 causing it to be angularly disposed so that the bottles will be slid from the feed rack 80 into the appropriate container as best shown in FIGS. 3, 4 and 5. Extending bracket 92 comprises two outwardly positioned arms 98 and 100 and a crossmember 102 which is suitably coupled thereto by welding. Brace 90 supports the piston 88.

Thus, there has been shown and described an apparatus which quickly and efficiently fills milk cartons with milk bottles. This apparatus can be used to fill any type of container into cartons with simple design and parameter changes, the bottles are gently slid from the holding platform 82 by the angular rotation of the feed rack 80 and into an awaiting carton 36. This is done without damage to the bottles and without the need for human intervention.

Having shown but one embodiment of this invention what is claimed is:

1. Apparatus for filling cases with bottles including:

a case filling station;

a first conveyor means for sequentially providing empty cases to the apparatus;

a second conveyor means for sequentially removing filled cases from the apparatus, said first conveyor means being disposed on an elevation to said apparatus higher than said second conveyor means;

a third conveyor means for sequentially providing bottles to be placed in the cases to the apparatus at said case filling station;

means disposed in said apparatus for positioning said case at predetermined positions on said ramp at said case filling station; and, means positioned at said case filling station for placing said bottles in said cases, said means for placing said bottles in said case including an angularly rotatable U-shaped member positioned over said platform for receiving a predetermined number of bottles in the open end of said U-shaped member and means for angularly rotating said U-shaped member when the predetermined number of bottles are placed therein to slide the bottles from said platform into an awaiting case at one of its predetermined positions.

2. The apparatus as defined in claim 1 and further including a horizontally disposed platform at said case filling station at the end of said third conveyor means to receive bottles therefrom.

3. The apparatus as defined in claim 1 wherein said means for positioning said case at predetermined positions at said case filling station including:

a plurality of downwardly depending stop mechanisms adapted to be positioned in the flow of cases on said ramp, and means positioning selected ones of said plurality of downwardly depending stop mechanisms at predetermined times.

4. Apparatus for filling cartons with liquid filled bottles or the like including:

a carton filling position;

first means for providing empty cartons to said carton filling position;

second means for providing filled cartons from said carton filling position; said first means being disposed on an elevation higher than said second means;

a ramp angularly disposed between said first means at the higher elevation and said second means at the lower elevation;

third means for sequentially providing the bottles to the carton filling station;

incrementing means for positioning a box to said carton filling station at one of a predetermined position; and filling means disposed at said carton filling station for placing a predetermined number of bottles into a carton at each incremented position, said filling means including; a platform disposed in alignment with said third means to receive a predetermined number of bottles therein, an angularly rotatable substantially U-shaped rack being disposed above said platform and adapted to receive a predetermined number of bottles within said U-shaped rack from said third means, and means for rotating said rack to slide the bottles from said platform into a carton.

5. The apparatus as defined in claim 4 and wherein said rack having a pair of substantially upstanding side members and an enclosed side and open side, said open side being aligned with said third means to receive bottles between said upstanding side member.

* * * * *